US005899791A

United States Patent [19]

Fildan

[11] Patent Number: 5,899,791

[45] Date of Patent: May 4, 1999

[54] STRAP-HOOK FOR LINGERIE SUCH AS BRASSIERES

[76] Inventor: Gerhard Fildan, Wohnpark Alte Eriaa, Anton Baumgartner Str. 44, C 4 17 01, A-1232 Vienna, Austria

[21] Appl. No.: 09/080,489

[22] Filed: May 18, 1998

[51] Int. Cl.[6] ..... A41B 3/12; A41D 27/00

[52] U.S. Cl. ..... 450/82; 2/73; 24/198; 24/200

[58] Field of Search ..... 2/73, 67, 311, 2/312, 313, 314, 315, 316, 317, 318, 319, 320, 321, 322, 323, 326, 336, 333, 334, 338; 450/58, 71, 72, 79, 80, 83, 84, 85, 82; 24/198, 200

[56] References Cited

U.S. PATENT DOCUMENTS

| | | | |
|---|---|---|---|
| Re. 21,619 | 11/1940 | Schottenfels | 24/200 |
| 745,884 | 12/1903 | Morton | 24/198 |
| 1,914,301 | 6/1933 | Schottenfels | 24/198 |
| 3,217,714 | 11/1965 | Silverman | 450/82 |
| 4,457,052 | 7/1984 | Hauber | 24/200 |

*Primary Examiner*—Jeanette Chapman

*Attorney, Agent, or Firm*—Herbert Dubno

[57] ABSTRACT

A hook closure for lingerie has an arcuate base from which a hook bar and an eye bar extend, the eye bar being provided with a slot defined between a thin and thick limb. A thick sewing flange projects away from the slot and enables the closure to be stitched to the fabric of a strapping passing to the eye and thereby limits shifting of the closure relative to the strap.

13 Claims, 3 Drawing Sheets

STRAP-HOOK FOR LINGERIE SUCH AS BRASSIERES

FIELD OF THE INVENTION

The present invention relates to a strap hook which can be used to connect straps at the rear of a brassiere, to connect shoulder straps of lingerie to fabric eyes attached to the garment, to provide a hook-type closure at the front of a brassiere between the cups thereof, or for any other purpose, especially in lingerie, between a fabric eye and a strap to which the hook is attached.

BACKGROUND OF THE INVENTION

It is not uncommon to provide a hook-type fastener between a strap and another member, e.g. a fabric eye or another strap, which can be molded from a synthetic resin and can be formed with an eye and a hook engageable in a fabric eye of another strap or a fabric eye formed directly as part of a garment.

Such systems are widely used for lingerie and can be made unitarily from synthetic resin material in a relatively thin form so that the hook-type fastener does not distress the wearer and can be easily engaged in a fabric eye or the like.

There are, however, some problems with hook-type fasteners which can have an elongated eye for receiving the strap, and a hook which can engage the fabric between the hook and the elongated eye.

For example, the fastener may not have sufficient strength to resist spreading of the hook member away from the eye portion, damage in a spreading respect damaging the hook-type fastener or resulting in undesired release of the parts of the garment connected thereby. In addition, the hook-type fastener tends to move relative to the strap on which it is mounted and frequently makes it difficult to engage the fastener in a fabric eye or loop or to use the hook-type fastener with the desired degree of facility.

Another drawback of the earlier hook-type fasteners or, in general, strap fasteners having elongated eyes, is that the fabric of the strap can gather at one corner, e.g. in the region of the hook, if stress is not applied equally over the length of the elongated opening through which the strap passes. The result is a twisting of the fastener relative to the strap and an improper lie of the strap.

OBJECTS OF THE INVENTION

It is, therefore, the principal object of the present invention to provide an improved hook-type fastener which can avoid the drawbacks of earlier fasteners and yet can avoid the drawbacks of earlier fasteners and yet can be easily fabricated, of an expensive construction and which offers greater facility with respect to manipulation and the like.

Another object of this invention is to provide a more reliable hook-type fastener of the general kind described.

It is also an object of this invention to provide a hook-type fastener which does not permit the strap fabric to gather at one end of an elongated opening through which the strap can pass and thus does not allow twisting of the fastener.

SUMMARY OF THE INVENTION

These objects and others which will become apparent hereinafter are attained, in accordance with the invention in a strap hook for connecting a strap to a fabric eye which comprises: a molded synthetic resin body formed with a base having an arcuate convex side and another side, a hook bar extending from the other side, an eye bar juxtaposed with the hook bar and extending from the other side of the base, the eye bar having a slot adapted to receive the strap and defined between a relatively thin limb disposed opposite the hook bar and a relatively thick limb spaced from the thin limb, and a relatively flat sewing flange on the thick limb extending therefrom away from the slot whereby the sewing flange can be stitched through to secure the strap to the strap hook, the hook bar being insertable into the fabric eye whereby fabric of the fabric eye is received between the thin limb and the hook bar.

More particularly, it has been found to be advantageous to provide the hook with a projection which overhangs a space in which the fabric of the fabric eye can be received, the hook having a bulging protuberance which, when this fabric is inserted between the hook and an eye bar, will press the fabric against a thin limb of the eye bar and thereby prevent release of the fabric.

According to another feature of the invention, the rounded bases of circularly segmented configuration and is provided with a plurality of recesses which may extend through the arcuate portion of the base. The recesses can be of triangular configuration.

According to an important feature of the invention, a sewing flange is formed unitarily on the thick limb and extends away from the slot between the thick and thin limbs and through which the fabric strap can be passed.

The thin limb is deflectable in the plane of the hook so that it presses against the fabric of the eye to increase the force with which the straps or the parts thereof are retained relative to the base.

A sewing flange on the thick member can be stitched through, as has been noted to secure the strap to the strap hook and provide some additional rigidity within the fabric strap immediately behind the hook to facilitate manipulation of the hook and engagement of the hook bar in the fabric eye.

The hook can be used, as has been noted, between the straps at the back of a brassiere or a similar garment, between a shoulder strap and a fabric eye of a brassiere or a slip or like garment, or even as a front closure between the cups of a brassiere or between fabric of the cup and a center panel of a brassiere in the case of a maternity or nursing brassiere.

A further advantage of the new hook-type closure is that it will not twist on the strap or permit the fabric of the strap to gather in one corner as is the case with earlier hook-type closures.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
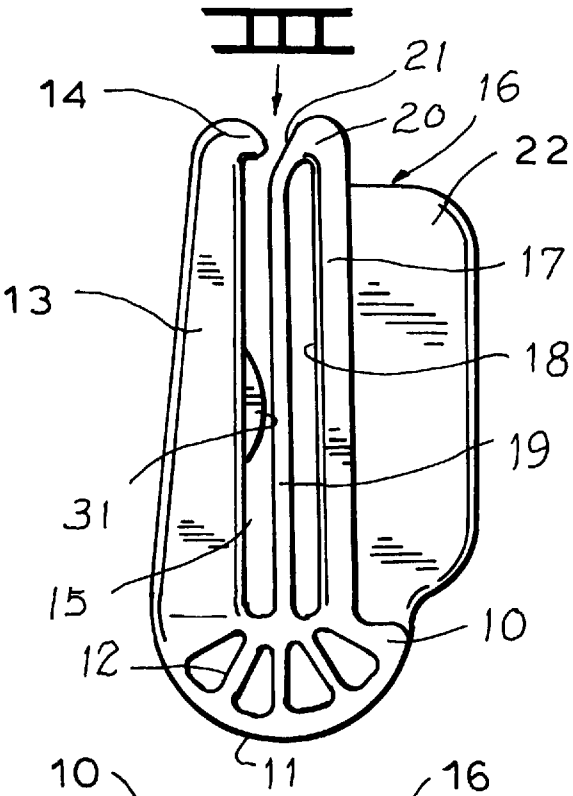
FIG. 1 is an elevational view of a hook closure embodying the principles of the invention.
Figure 3:
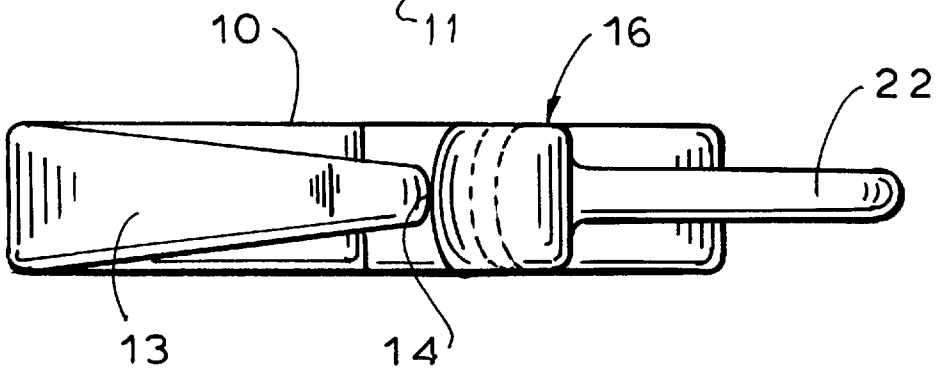
FIG. 3 is a view drawn to a larger scale of the closure seen in the direction of the arrow III in FIG. 1.

In FIG. 1 I have shown a hook type closure which is molded in one piece from a polyamide synthetic resin and preferably a glass reinforced polyamide.

The closure has a base 10 which has a circular arc convex side 11 formed with recesses or cutouts 12 of triangular configuration to facilitate gripping. Instead of cutouts or recesses, entrainment or gripping can be provided by embossing a triangle pattern on the base similar to the recessed pattern in FIG. 1 from the side of the base opposite the arcuate portion 11, a hook bar 13 extends. This bar tapers away from the base and terminates in a projection 14 overhanging a space 15 between the hook bar 13 and an eye bar generally represented at 16.

The eye bar 16 comprises a relatively thick limb 17 defining an elongated slot 18 with a relatively thin limb 19, the latter being deflectable when the fabric of a fabric eye passes into the space 15.

At their ends remote from the base 10, the limbs 17 and 19 are interconnected at 20 and the connection 20 is formed with an inclined surface 21 forming a guide slot with the projection 14 which guides the fabric into the space 15.

The thick limb 17, over a portion of the height thereof, is provided with a sewing flange 22 which is planar.

Figure 2:
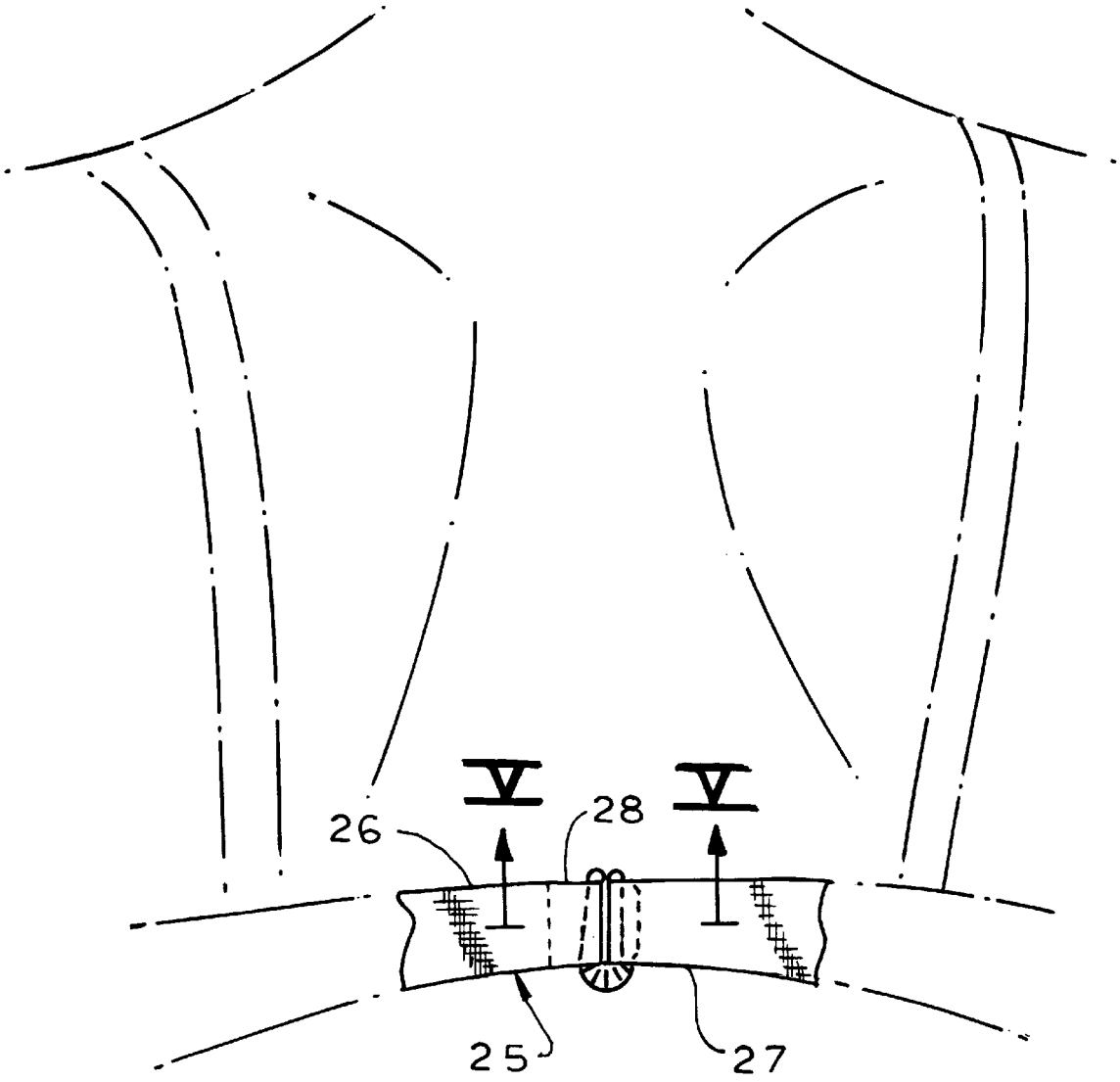
FIG. 2 shows the application of the hook closure of FIG. 1 in a diagrammatic elevational view of the back of a brassiere.
Figure 4:
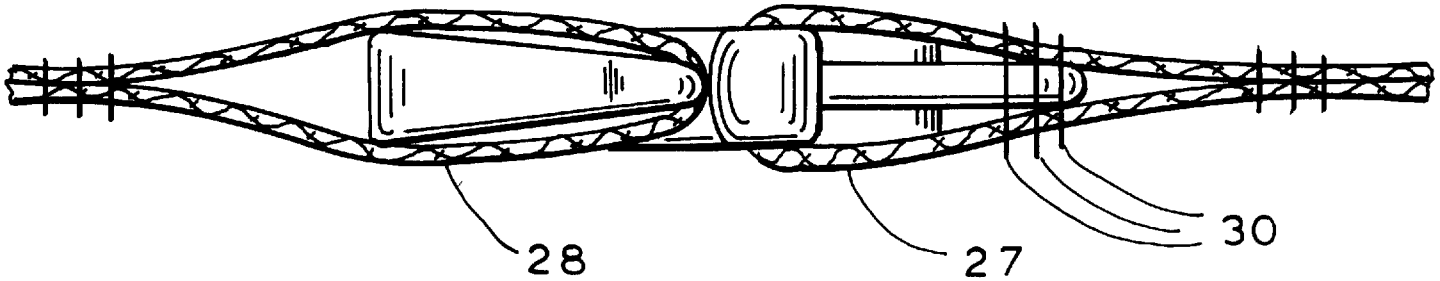
FIG. 4 is a similar view showing straps connected by the closure.

A typical thickness of the sewing flange, in the case of a polyamide hook closure, is 0.7 mm. The base 10 can have a thickness of say 2.2 to 3 mm, preferably 2.5 mm to 2.8 mm. The thickness of the hook bar 13 at its end remote from the base 10 may be between 1.4 and 2 mm, preferably between 1.5 mm and 1.7 mm. The hook type closure can be utilized, for example, as the back closure for a brassiere as shown at 25 in FIG. 2. The brassiere 25 can have a pair of back straps 26 and 27. The strap 27 can pass through the slot 18 and can be stitched to the flange 22, while a fabric eye 28 can be formed on the other strap and engaged by the hook bar 13 which can be slipped into this eye from below. In FIG. 4, the eye 28 is shown in greater detail and it also will be apparent that the strap 27 is stitched through at 30 in the region of the sewing flange 22.

Figure 5:
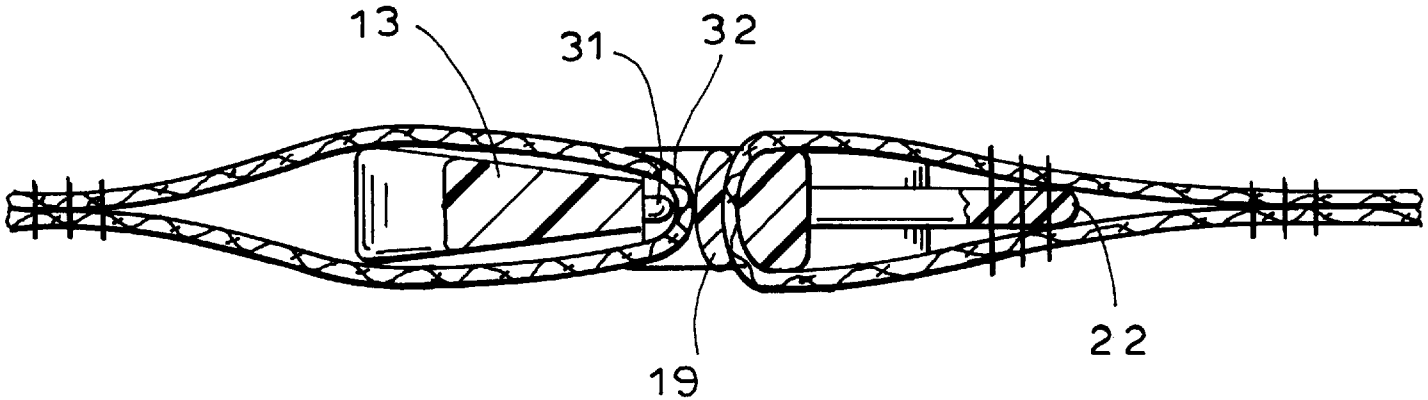
FIG. 5 is a cross sectional view taken along the line V—V of FIG. 2.

Substantially midway along the height of the hook bar 13, a rounded protuberance 31 is provided to grip the fabric 32 of the eye 28 between the hook bar 13 and the thin deflectable limb 19 (see FIG. 5). The arcuate configuration of the base facilitates gripping thereof and imparts strength to the closure which has been found to be suitable for relatively wide straps, i.e. straps of widths ranging from ¾ of an inch to 2 inches or 20 to 50 mm.

I claim:

1. A strap hook for connecting a strap to a fabric eye, comprising a molded synthetic resin body formed with a base having an arcuate convex side and another side, a hook bar extending from said other side, an eye bar juxtaposed with said hook bar and extending from said other side of said base, said eye bar having a slot adapted to receive said strap and defined between a relatively thin limb disposed opposite said hook bar and a relatively thick limb spaced from said thin limb, and a relatively flat sewing flange on said thick limb extending therefrom away from said slot whereby said sewing flange can be stitched through to secure said strap to said strap hook, said hook bar being insertable into said fabric eye whereby fabric of said fabric eye is received between said thin limb and said hook bar.

2. The strap hook defined in claim 1 wherein said hook bar is generally parallel to said limbs and is formed at an end of said hook bar remote from said base with a projection overhanging a space between said hook bar and said eye bar and through which fabric of said fabric eye passes.

3. The strap hook defined in claim 2 wherein said hook bar is formed between said projection and said base with a protuberance bulging in a direction of said thin limb and gripping said fabric of said fabric eye between said protuberance and said thin limb.

4. The strap hook defined in claim 3 wherein said thin limb and thick limb are interconnected at an end of said eye bar remote from said base.

5. The strap hook defined in claim 4 wherein said sewing flange extends only over part of the height of said thick limb.

6. The strap hook defined in claim 5 wherein said bars and said base are unitarily formed from a synthetic resin.

7. The strap hook defined in claim 6 wherein said synthetic resin is a polyamide.

8. The strap hook defined in claim 7 wherein said convex side has a configuration of a circular segment.

9. The strap hook defined in claim 8 wherein said circular segment is formed with a plurality of recesses.

10. The strap hook defined in claim 9 wherein said recesses have generally triangular configurations.

11. The strap hook defined in claim 10 wherein said recesses are cutouts extending through said base.

12. The strap hook defined in claim 11 wherein a slot is formed between said protuberance and said eye bar guides said fabric of said fabric eye into said space.

13. The strap hook defined in claim 11 wherein said slot is inclined to said hook bar and said limbs.

* * * * *